US005685802A

United States Patent [19]

Kanno

[11] Patent Number: 5,685,802

[45] Date of Patent: Nov. 11, 1997

[54] ENGINE CONTROL SYSTEM

[75] Inventor: Isao Kanno, Hamamatsu, Japan

[73] Assignee: Sanshin Kogyo Kabushiki Kaisha, Hamamatsu, Japan

[21] Appl. No.: 595,817

[22] Filed: Feb. 2, 1996

[30] Foreign Application Priority Data

Feb. 2, 1995 [JP] Japan ..... 7-015984

[51] Int. Cl.[6] ..... B63H 21/26

[52] U.S. Cl. ..... 477/111; 290/40 C

[58] Field of Search ..... 477/107, 111, 477/113; 123/350; 290/40 C

[56] References Cited

U.S. PATENT DOCUMENTS

| | | | |
|---|---|---|---|
| 4,402,288 | 9/1983 | Ohgami et al. | 290/40 C |
| 4,454,464 | 6/1984 | Stroud | 322/28 |
| 4,604,565 | 8/1986 | Yokota et al. | 320/15 |
| 4,677,365 | 6/1987 | Yang | 322/90 |
| 5,013,991 | 5/1991 | Brune | 320/15 |
| 5,057,764 | 10/1991 | Fujimoto et al. | 322/14 |
| 5,245,267 | 9/1993 | Pierret et al. | 320/15 |
| 5,270,575 | 12/1993 | Togai et al. | 290/40 C |
| 5,293,076 | 3/1994 | Fukui | 290/40 C |
| 5,402,007 | 3/1995 | Center et al. | 290/40 C |
| 5,545,928 | 8/1996 | Kotani | 290/40 C |

*Primary Examiner*—Dirk Wright

*Attorney, Agent, or Firm*—Knobbe, Martens, Olson & Bear LLP

[57] ABSTRACT

An internal combustion engine particularly adapted for driving a vehicle, such as a watercraft, that includes accessories and an engine management system for controlling certain functions of the engine electrically. In order to prevent misadjustment in the event of low available battery voltage, a number of arrangements are depicted for maintaining battery voltage when the normal battery voltage falls. This may be done by increasing engine speed when operating in neutral, discontinuing the operation of other accessories and/or switching a second battery into the power circuit. In addition, an arrangement is provided wherein a battery may be supplied for utilization in starting of the engine to avoid depletion of the main battery's voltage so that the engine control can be maintained even during starting.

24 Claims, 5 Drawing Sheets

ENGINE CONTROL SYSTEM

BACKGROUND OF THE INVENTION

This invention relates to a control system and method for an internal combustion engine and more particularly to an improved control system for an engine employing an electrically actuated component that provides protection in the event of a decrease in electrical power.

As is well known, internal combustion engines rely heavily on electrically operated components. Although at one time the only electrical component on an engine was its ignition system, now a number of the engine functions are controlled or monitored electrically. For example, many forms of fuel injectors employ electric solenoid operated valves which control the timing and duration of fuel injection. In addition, the ignition timing, fuel control, and a number of other portions of the engines may be controlled by electric modules.

Most engine applications employ an engine driven generator which generates electricity. Rather than providing the power directly from the generator, however, the generator is utilized to charge a storage battery and the storage battery supplies the actual electrical power to the engine components for their actuation. In this way, the voltage of the electricity supplied tends to be more stable.

However, there may be instances wherein the battery power becomes depleted. In this instance, a number of the engine controls can be adversely affected resulting in undesirable engine performance. For example, if the voltage available for energizing the solenoid of the fuel injector falls, the injector performance will deteriorate and the amount of fuel supplied will vary from that which is desired. Similar results may occur with other electrical components.

It is, therefore, a principal object of this invention to provide an improved engine and control system that employs an electrically actuated component for the engine, a battery for supplying electricity to the component and an arrangement for sensing when the battery voltage falls below a predetermined value at which the component performance may be affected and provides an additional electric power under these circumstances to maintain the performance as desired.

One example of a condition when the battery power may become depleted and wherein the generator may not supply sufficient charging to keep the battery up to the necessary voltage to correctly operate the electrical components for the engine is when the engine is idling. Engine idle is a very difficult condition under even the best circumstances and, if the available voltage varies during idle operation, then the engine performance can be further deteriorated.

It is, therefore, a still further object of this invention to provide an improved electrical system and control for an engine wherein an additional source of electrical power is made available during periods when the engine is operating at a low speed.

Another condition when the engine control may be adversely affected due to low available electric power is during starting. As is well known, many engine applications employ electric starters for starting the engines. The electric starter consumes a large amount of power and this may delete the power available for operating the other engine accessories so that engine starting can be made more difficult.

It is, therefore, a still further object of this invention to provide an improved engine control method wherein additional electric power is available on starting.

In many applications, the vehicle powered by the engine may employ an auxiliary battery for providing electric power for accessories of the vehicle which are not necessarily associated with the engine. For example, in watercraft it is frequently the practice to have one battery that serves the primary function of supplying electric power to the engine and another battery that supplies electrical power for accessories, such as lights, etc. It may be that this auxiliary battery is, at times, also charged from the engine generator. However, if this is the case, it is desirable to ensure that the batteries are electrically isolated from each other.

It is, therefore, a still further object of this invention to provide an improved system that employs a pair of batteries and wherein the batteries are isolated electrically form each other, but may be both utilized to communicate with the same source or load.

SUMMARY OF THE INVENTION

A first feature of this invention is adapted to be embodied in a method and control for an internal combustion engine having an output shaft. The engine includes at least one electrically operate component which is required for operation of the engine. A battery is provided to supply electrical power. A generator is driven by the engine output shaft and charges the battery through a charging circuit.

In accordance with a control for an engine constructed in accordance with this first feature of the invention, a voltage sensor is provided for sensing the voltage condition of the battery and an arrangement is provided for increasing the voltage available to the electrically operated component when the voltage sensor senses a battery voltage lower than a predetermined value.

In accordance with a method for practicing this feature of the invention, the battery voltage is sensed. If the sensed voltage falls below a predetermined value, the voltage available for operating the electrically operated component is increased.

A still further feature of the invention is adapted to be embodied in an engine control system that includes a first battery for operating an engine and a second battery for operating accessories other than the engine. The batteries are both connected to engine operating parts through reverse current flow preventing diodes.

DETAILED DESCRIPTION OF THE PREFERRED EMBODIMENTS

Figure 1:
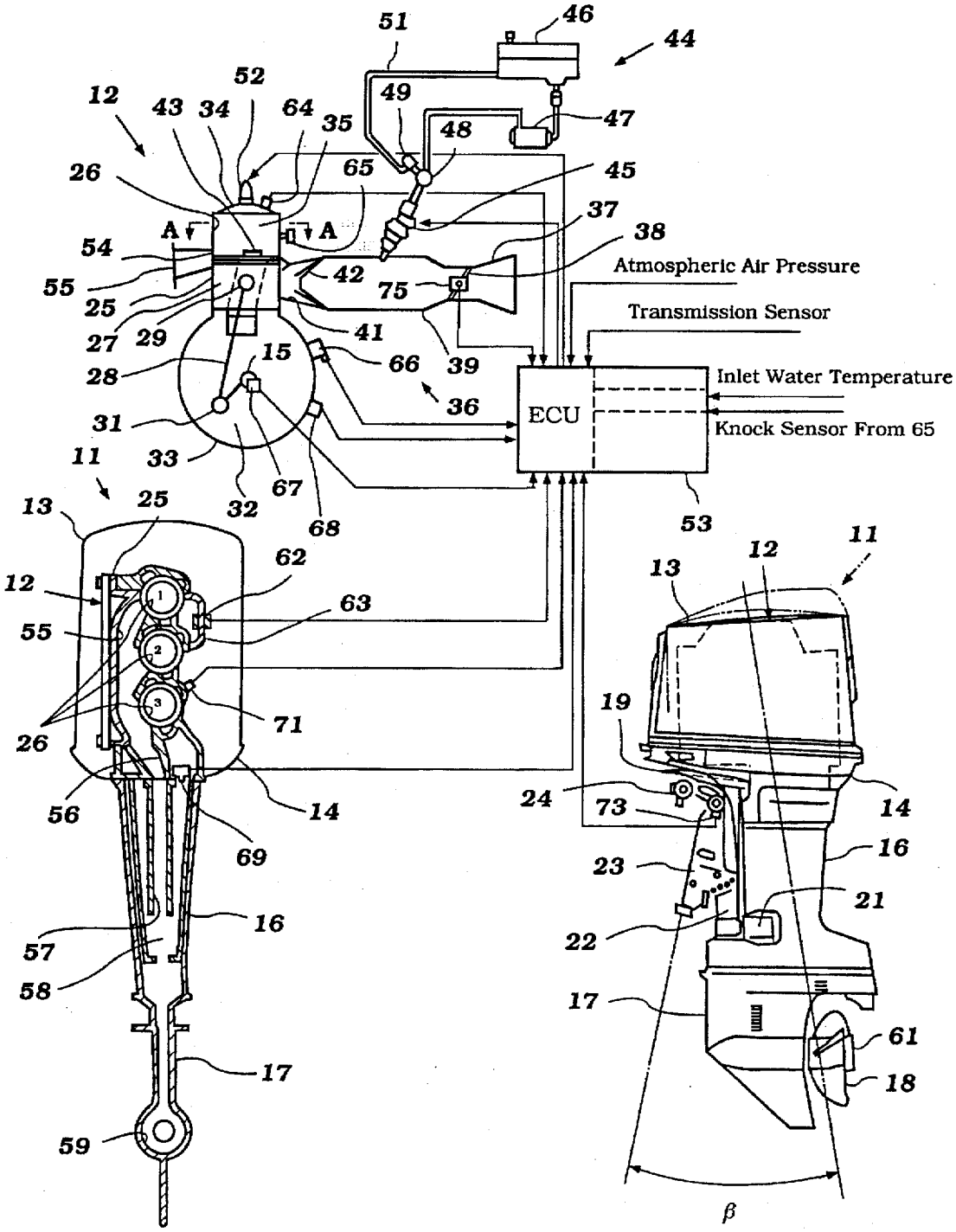
FIG. 1 is a composite view consisting of, at the bottom, right hand side, a partial side elevational view of an outboard motor constructed and operated in accordance with an embodiment of the invention. The lower, left hand view of this figure is a cross sectional view taken generally along the line A—A of the remaining view. This remaining, upper view is a partially schematic cross sectional view taken through a single cylinder of the engine showing the components associated with the control system.

Referring now in detail to the drawings and initially to FIG. 1, an outboard motor constructed in accordance with an embodiment of the invention is identified generally by the reference numeral 11. The invention is described in conjunction with an outboard motor because the invention deals with an internal combustion engine and the control system therefor. Therefore, an outboard motor is a typical application in which an engine constructed and operated in accordance with the invention may be utilized.

The outboard motor 11 is comprised of a power head that consists of a powering internal combustion engine, indicated generally by the reference numeral 12 and a surrounding protective cowling comprised of a main cowling portion 13 that is detachably connected to a tray portion 14.

As is typical with outboard motor practice, the engine 12 is supported within the power head so that its output shaft, a crankshaft indicated by the reference numeral 15 in the upper view of this figure, rotates about a vertically-extending axis. This output shaft or crankshaft 15 is rotatably coupled to a drive shaft (not shown) that depends into and is journaled within a drive shaft housing 16. The tray 14 encircles the upper portion of the drive shaft housing 16.

The drive shaft continues on into a lower unit 17 where it can selectively be coupled to a propeller 18 for driving the propeller 18 in selected forward or reverse direction so as to so propel an associated load, namely a watercraft. A conventional forward reverse bevel gear transmission (shown schematically in FIG. 2 and indicated by the reference numeral 20) is provided for this purpose.

A steering shaft (not shown) having a tiller 19 affixed to its upper end is affixed in a suitable manner, by means which include a lower bracket assembly 21, to the drive shaft housing 16. This steering shaft is journaled within a swivel bracket 22 for steering of the outboard motor 11 about a vertically-extending axis defined by the steering shaft.

The swivel bracket 22 is, in turn, connected to a clamping bracket 23 by means of a trim pin 24. This pivotal connection permits tilt and trim motion of the outboard motor 11 relative to the associated transom of the powered water craft. The trim adjustment through the angle β permits adjustment of the angle of the attack of the propeller 18 to obtain optimum propulsion efficiency. In addition, beyond the range defined by the angle β, the outboard motor 11 may be tilted up to and out of the water position for trailering and other purposes, as is well known in this art.

The construction of the outboard motor 11 as thus far described may be considered to be conventional and for that reason, further details of this construction are not illustrated nor are they believed necessary to permit those skilled in the art to practice the invention.

Continuing to refer to FIG. 1 but now referring primarily the lower left hand portion of this figure and the upper portion, the engine 12 is, in the illustrated embodiment, of the three-cylinder in-line type. To this end, the engine 12 is provided with a cylinder block 25 in which three horizontally extending, vertically aligned, parallel cylinder bores 26 are formed. Although the invention is described in conjunction with a three-cylinder in-line engine, it will be readily apparent to those skilled in the art how the invention may be utilized with engines having various cylinder numbers and cylinder configurations. In addition, the invention may also be employed with four stroke engines.

Pistons shown schematically at 27 in FIG. 1 are connected to connecting rods 28 by means of piston pins 29. The lower or big ends of the connecting rods 28 are journaled on respective throws 31 of the output shaft or crankshaft 15, as is well known in this art.

The crankshaft 15 is rotatably journaled within a crankcase chamber 32 formed at the lower ends of the cylinder bores 26. The crankcase chambers 32 are formed by the skirt of the cylinder block 25 and a crankcase member 33 that is affixed to the cylinder block 25 in any well known manner. As has been noted, the engine 12 operates on a two-cycle crankcase compression principal. As is typical with such engines, the crankcase chambers 32 associated with each of the cylinder bores 26 are sealed relative to each other in any suitable manner.

The ends of the cylinder bores 26 opposite the crankcase chambers 32 are closed by means of a cylinder head assembly 34 that is affixed to the cylinder block 25 in any known manner. The cylinder head 34 has recesses which cooperate with the cylinder bores 26 and the heads of the pistons 27 to form combustion chambers, indicated generally by the reference numeral 35. These combustion chambers 35 have a volume which varies cyclically during the reciprocation of the pistons 27 as is well known in this art.

An intake charge is delivered to the crankcase chambers 32 for compression therein by means of a charge forming and induction system, indicated generally by the reference numeral 36. The charge forming and induction system 36 includes an air inlet device 37 that is disposed within the protective cowling of the power head and which draws air therefrom. This air is admitted to the interior of the protective cowling by one or more air inlets formed primarily in the main cowling member 13.

A throttle valve 38 is positioned in the induction passage or intake manifold 39 that connects the air inlet device 37 to respective intake ports 41 formed in the cylinder block 25 and which communicate with the crankcase chambers 32 in a well known manner.

Reed type check valves 42 are provided in each of the intake ports 41 so as to permit a charge to flow into the crankcase chambers 32 when the pistons 27 are moving upwardly in the cylinder bores 26. On the other hand, when the pistons 27 move downwardly these valves 42 close and the charge is compressed in the crankcase chambers 32. The compressed charge is transferred to the combustion chambers 35 through one or more scavenge passages 43.

Fuel is supplied to the air charge admitted as thus far described by a charge forming system, indicated generally by the reference numeral 44. This charge forming system 44 includes one or more fuel injectors 45 that spray into each of the intake passages 39. The fuel injectors 45 are of the electrically operated type having electrically actuated solenoid valves (not shown) that control the admission or spraying of fuel into the intake passages 39 upstream of the check valves 42.

Fuel is supplied to the fuel injectors from a remotely positioned fuel tank 46. The fuel tank 46 is, most normally, positioned within the hull of the associated watercraft as is well known in this art. The fuel is drawn through a supply conduit by a pumping system including a high pressure pump 47 which discharges into a main fuel rail 48. The fuel rail 48 supplies fuel to each of the fuel injectors 45 in a known manner.

A pressure control valve 49 is provided in or adjacent the fuel rail 48 and controls the maximum pressure in the fuel rail 48 by dumping excess fuel back to the fuel tank 46 or some other place in the system upstream of the fuel rail 48 through a return conduit 51. The fuel that is mixed with the air in the induction and charge forming system 36 as thus far described will be mixed and delivered to the combustion chambers 35 through the same path already described.

Spark plugs 52 are mounted in the cylinder head 34 and have their gaps extending into the respective combustion chambers 35. These spark plugs 52 are fired by ignition coils (shown schematically in FIG. 2 and identified by the reference numeral 50) that are actuated by an ignition circuit that is controlled by a control means which includes an electronic control unit or ECU 53 which will be discussed in detail later.

When the spark plugs 52 fire, the charge in the combustion chambers 35 will ignite, burn and expand. This expanding charge drives the pistons 27 downwardly to drive the crankshaft 15 in a well known manner. The exhaust gases are then discharged through one or more exhaust ports 54 which open through the sides of the cylinder block bores 26 and communicate with an exhaust manifold 55 as shown schematically in the upper view of FIG. 1 and in more detail in the lower left side view of this figure.

Referring now primarily to the lower left hand side view of FIG. 1, the exhaust manifold 55 terminates in a downwardly facing exhaust discharge passage 56 that is formed in an exhaust guide plate upon which the engine 12 is mounted. This exhaust guide plate delivers gases to an exhaust pipe 57 that depends into the drive shaft housing 16.

The drive shaft housing 16 defines an expansion chamber 58 in which the exhaust pipe 57 terminates. From the expansion chamber 58, the exhaust gases are discharged to the atmosphere in any suitable manner such as by means of a underwater exhaust gas discharge 59 which discharges through the hub 61 of the propeller 18 in a manner well known in this art. At lower speeds when the propeller 18 is more deeply submerged, the exhaust gases may exit through and above the water atmospheric exhaust gas discharge (not shown) as also is well known in this art.

In addition to controlling the timing of the firing of the spark plugs 52, the ECU 53 also controls the timing and duration of fuel injection 6f the fuel injector 45 and may control other engine functions. For this purpose, there are provided a number of engine and ambient condition sensors. In addition, there is provided a feedback control system through which the ECU 53 controls the fuel air ratio in response to the measurement of the actual fuel air ratio by a combustion condition sensor such as an oxygen ($O_2$) sensor 62 which is positioned in a passageway 63 that interconnects two of the cylinder bores 26 at a point adjacent the point where the exhaust passages 54 are located, In addition to the $O_2$ sensor, other sensors of engine and ambient conditions are provided. These include an in cylinder pressure sensor 64 and knock sensor 65 that are mounted in the cylinder head 34 and cylinder block 25, respectively. The outputs from these sensors are transmitted to the ECU 53.

Air flow to the engine may be measured in any of a variety of fashions and this may be done by sensing the pressure in the crankcase chamber 32 by means of a pressure sensor 66. As is known, actual intake air flow can be accurately measured by the measuring the pressure in the crankcase chamber 32 at a specific crank angle. A crank angle position sensor 67 is, therefore, associated with the crankshaft 15 so as to output a signal to the ECU 53 that can be utilized to calculate intake air flow and, accordingly, the necessary fuel amount so as to maintain the desired fuel air ratio. The crank angle sensor 67 may be also used as a means for measuring engine speed, as is well known in this art.

Intake air temperature is measured by a crankcase temperature sensor 68 which is also positioned in the crankcase 33 and senses the temperature in the crankcase chambers 32.

Exhaust gas back pressure is measured by a back pressure sensor 69 that is mounted in a position to sense the pressure in the expansion chamber 58 within the drive shaft housing 16.

Engine temperature is sensed by an engine temperature sensor 71 that is mounted in the cylinder block 25 and which extends into its cooling jacket. In this regard, it should be noted that the engine 12 is, as is typical with outboard motor practice, cooled by drawing water from the body of the water in which the outboard motor 11 operates. This water is circulated through the engine 12 and specifically its cooling jackets and then is returned to the body of water in any suitable return fashion.

The temperature of the intake water drawn into the engine cooling jacket is also sensed by a temperature sensor which is not illustrated but which is indicated by an arrow and legend in FIG. 1. In addition other ambient conditions such as atmospheric air pressure are transmitted to the ECU 53 by appropriate sensors and as indicated by the arrows in FIG. 1.

Figure 2:
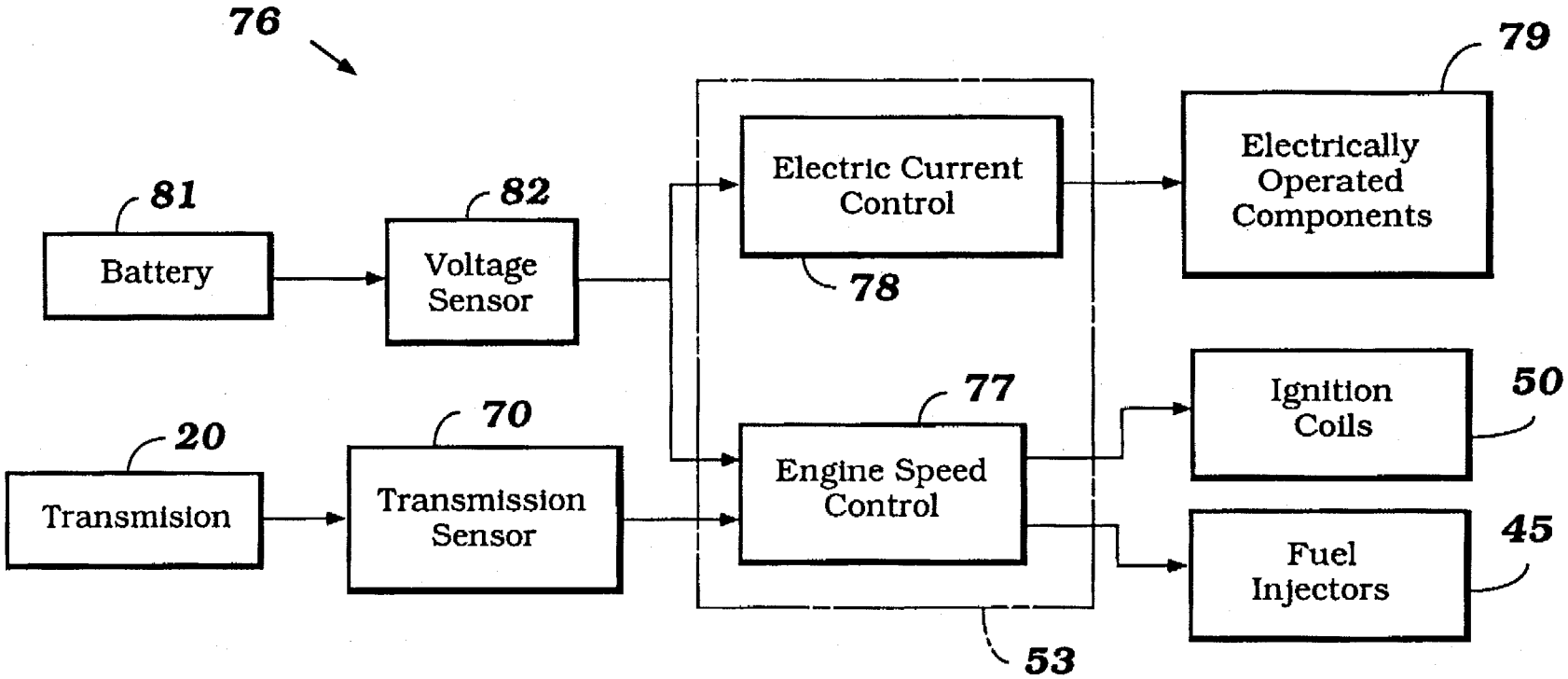
FIG. 2 is a graphical view showing elements of the control system for the outboard motor in accordance with an embodiment of the invention.

The condition of the transmission 20 which, as has been noted, couples the drive shaft to the propeller 18 is determined by a transmission sensor 70 as shown schematically in FIG. 2, the output of which is indicated by the arrow in FIG. 1. This sensor indicates the condition of the transmission as to whether it is in a neutral or in a driving condition.

A trim angle sensor 73 is provided adjacent the trim pin 24 so as to provide a signal indicative of the angle $\beta$.

A throttle angle position sensor 75 is also provided and outputs a signal indicative of the position of the throttle valve 38 to the ECU 53.

As previously stated, the ECU 53 controls the ignition timing for the engine 12 and the timing and duration for the fuel injectors 45. Additionally, the ECU 53 also controls the powering of various additional electrically operated engine components. The power for the electrically operated engine components, as well as for the ignition and fuel injection systems, is provided by a battery that is charged by a charging circuit that includes a flywheel magneto generator (shown later in FIG. 6) which is driven by the output shaft 15 of the engine 12.

Although the battery is charged through a regulating circuit of any known type, a problem may at times exist with this configuration and inadequate or low voltage may only be available. This can exist under conditions of lower engine speeds, such as when the engine is idling or when trolling for long time periods. Under such conditions the generator is driven by the output shaft at a rate that is insufficient for replenishing the charge in the battery. Thus, the battery power becomes depleted and the electrically operated engine components are adversely affected. An embodiment of this invention eliminates this adverse situation by ensuring that the charging circuit is fully able to replenish the charge in the battery regardless of the engine operating conditions and is described with reference to FIG. 2.

As seen in FIG. 2, a control means that is indicated by the reference numeral 76 is incorporated in the ECU 53. This includes an engine speed control circuit 77 which controls the operation of the ignition coils 50 and fuel injectors 45.

In addition an electric current control circuit 78 which controls the amount of electricity available for other electrically operated engine components that are indicated collectively by the reference numeral 79. Both the engine speed control circuit 77 and the electric current control circuit 78 are powered by a battery, which is indicated by the reference numeral 81 and whose electrical charge level is monitored by a voltage sensor 82. Additionally, the transmission sensor 70 provides the engine speed control circuit 77 a signal that indicates whether the transmission is in a neutral or driving condition.

When the engine 12 is idling, the generator is not driven at a rate sufficiently high to allow the charging circuit to replenish the charge in the battery 81. Thus, the charge in the battery 81 will deplete. When the charge in the battery 81 drops below a certain predetermined voltage level, the voltage sensor 82 will signal the ECU 53. If, at the same time, transmission sensor indicates that the transmission is in a neutral condition, the engine speed control circuit 77 will increase the engine speed by advancing the ignition timing or the injection timing and duration or both.

This increase in engine speed will increase the speed at which the generator is driven and thus the charging capabilities of the charging system will now fully replenish the charge in the battery 81 and thus increase the available voltage. Thus, the above control method ensures that the battery 81 will have sufficient charge to meet the operating demands of the outboard motor 11 and its electrically operated engine components 79, even when the engine 12 is idling. The engine speed control circuit 77 will also discontinue the operation of the engine 12 at the higher engine speed whenever a signal from the transmission sensor indicates that the transmission is in a driving condition since, in this condition, the generator is normally driven by the output shaft 15 at a rate sufficient to replenish the charge in the battery 81. Additionally, this also ensures against excessive engine speed causing the watercraft driven by the outboard motor 12 to travel at a rate above the operator demand.

In addition to powering the electrically operated engine components 79, the battery 81 also powers non-engine related electrically operated components that are indicated by the reference numeral 83 such as any lighting or radio navigational equipment associated with the watercraft that is driven by the outboard motor 11, all of which deplete the battery 81 and decreases the available voltage for the electrically operated engine components 79.

A further embodiment of this invention utilizes the electric current control circuit 78 to increase the voltage available to the electrically operated engine components 79 and is described with further reference to FIG. 2.

As previously stated, the voltage sensor 82 signals the ECU 53 if the battery voltage drops below a certain predetermined level. This signal is sent to both the engine speed control circuit 77 and the electric current control circuit 78. If such a low battery voltage signal is received by the electric current control circuit 78 it will discontinue the supply of electrical power to the non-engine related electrically operated components 83 and thus reduce the power demands on the battery 81 and increase the voltage available to the engine components. This also will more readily allow the charging system to recharge the battery 81 and has an added advantage in that it may also be in operation even when the transmission is in a driving condition.

Figure 4:
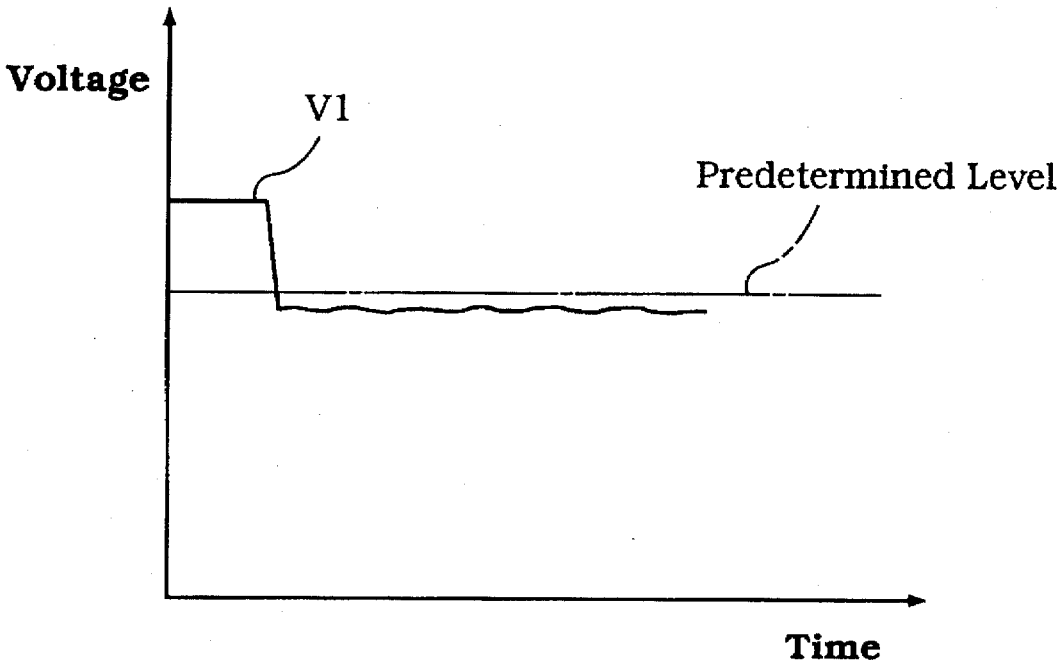
FIG. 4 is a graphical view showing the relationship between the voltage of a first battery of the electrical powering system and time.

It is often the practice for outboard motors to utilize an electric starter 87 as a means by which to initiate the operation of the engine 12. These starters tend to consume a large amount of available battery power and may deplete the battery 81 such that its voltage level, indicated by V1 in FIG. 4, falls below the minimum predetermined voltage and is insufficient to properly power the engine and non-engine related electrically operated components 79 and 83 respectively.

An embodiment of this invention utilizes a further control means which includes a second battery 89, normally utilized for powering the non-engine related electrically operated components 83. If the normally utilized engine, first battery 85 is in a low voltage condition, the second battery 89 is also utilized for powering a starter to reduce the load on the first battery 85.

Figure 3:
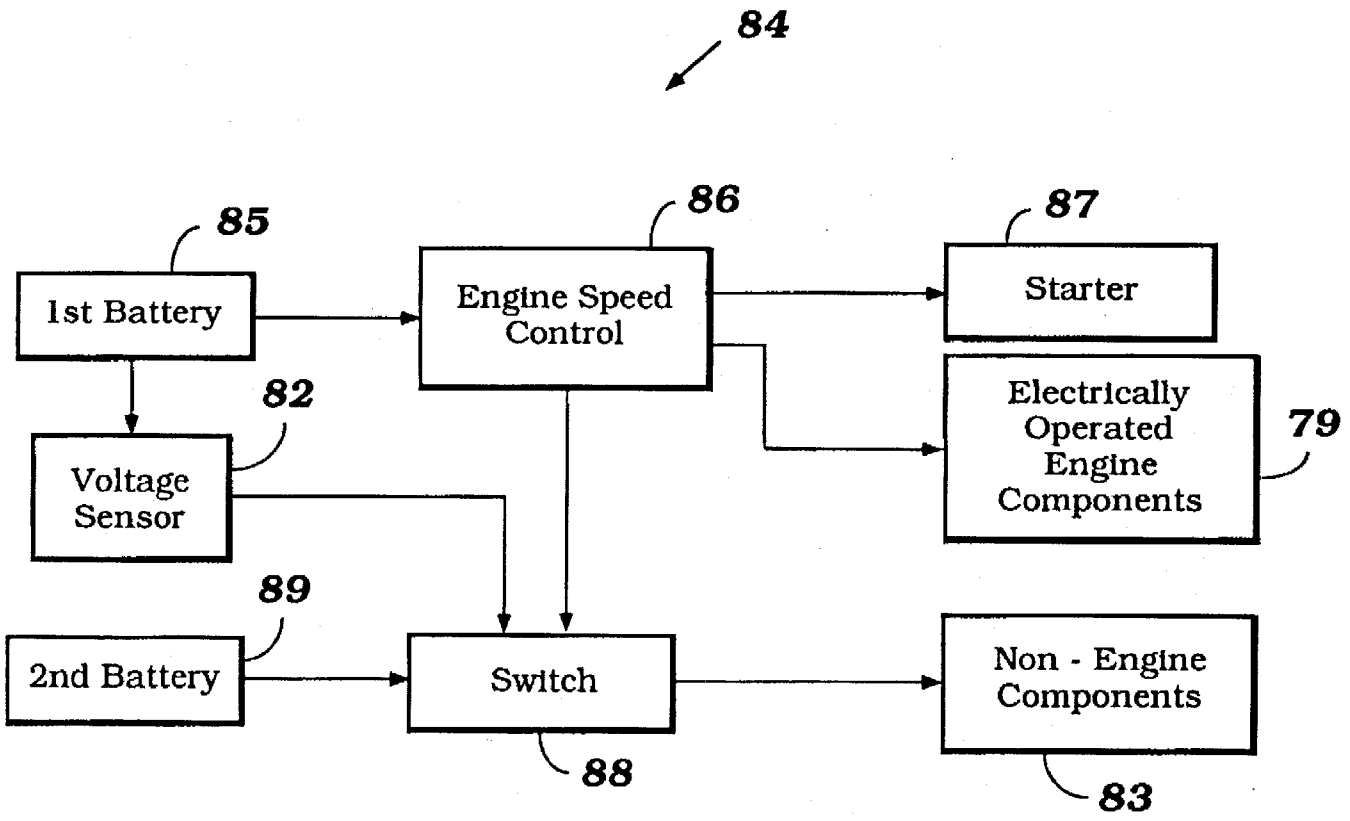
FIG. 3 is a graphical view similar to FIG. 2 and shows another embodiment of the invention.

Referring now to FIG. 3, a control means is indicated by the reference numeral 84 and consists of the first battery 85 which powers an engine start circuit 86 that is incorporated within the ECU 53. The engine start circuit 86 actuates the starter 87 and controls the operation of the electrically operated engine components 79. The charge in the first battery 85 is monitored by the voltage sensor 82 which outputs a signal to a switch 88.

Figure 5:
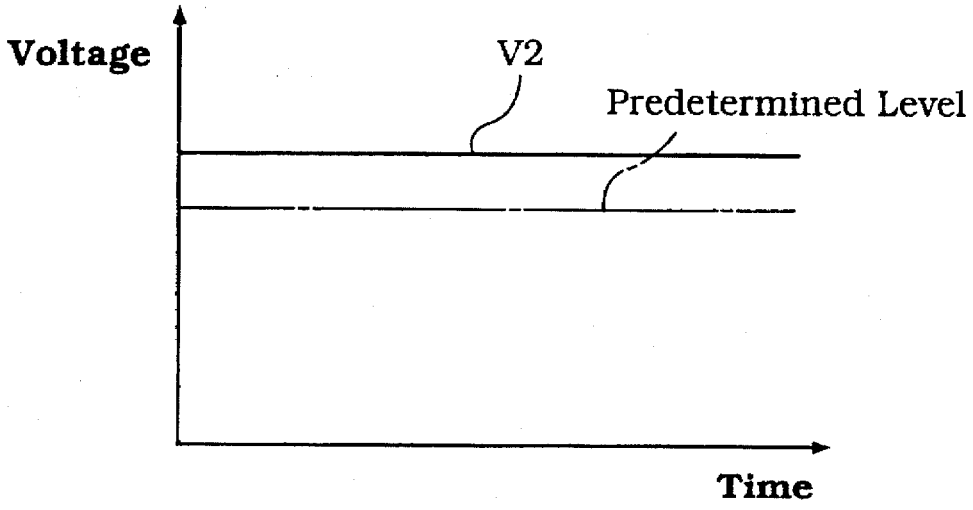
FIG. 5 is a graphical view showing the relationship between the voltage of a second battery of the electrical powering system and time.

The second battery 89 powers the non-engine related electrically operated components 83 through the switch 88 and may also be used to power the starter 87 in a manner now described. When the voltage in the first battery 85 is below a predetermined level, the voltage sensor 82 will signal the switch 88 which will, in turn, open a circuit that enables the second battery 89 whose voltage V2, as shown in FIG. 5, is above the desired predetermined level to be used for powering the starter 87 and the electrically operated engine components 79 during start-up.

Thus, adequate charge is provided by the control means 84 to ensure that the engine 12 can be started even in circumstances where the charge in the first battery 85 is depleted. In addition, the engine electrical components will have available adequate voltage to operate correctly.

Figure 6:
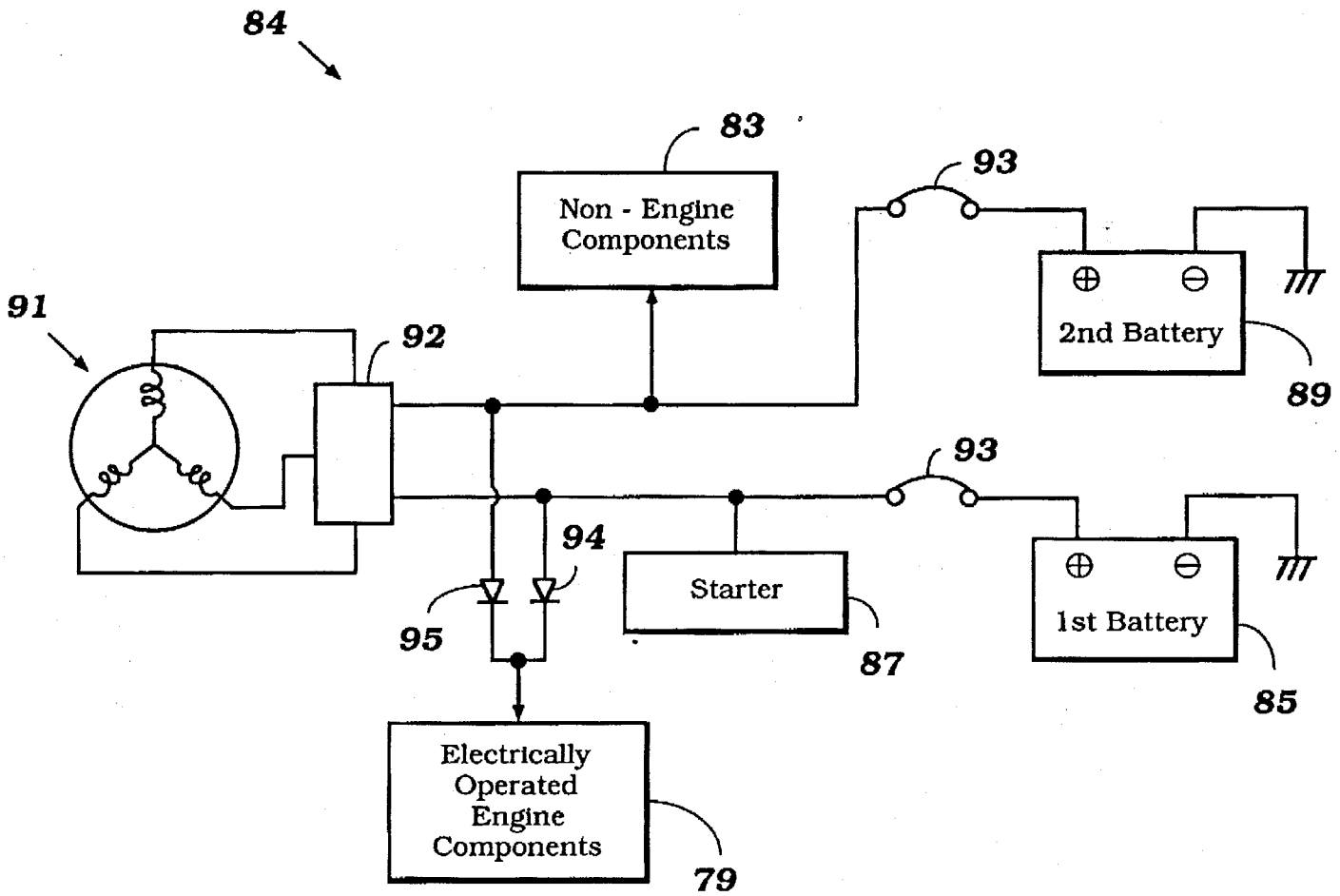
FIG. 6 is a schematic view showing the electrical powering system for the outboard motor in accordance with yet another embodiment of the invention.

FIG. 6 illustrates a further embodiment of the invention where the control means 84 of the previous embodiment has been modified in order to ensure that the first and second batteries 85 and 89, respectively, are electrically isolated from one another so that one will not deplete the charge in the other.

The engine driven flywheel magneto includes a three coil power source, indicated by the reference numeral 91. This is utilized, as previously noted as the powering agent or generator for charging the batteries 85 and 89. A voltage regulator 92 regulates the charge from the three-way coil 91 to the batteries 85 and 89, while fuses 93 safeguard the batteries in the event of an excessive power surge.

The first battery 85 supplies electrical power to the starter 87 and the electrically operated engine components 79 through a diode 94 while the second battery 88 supplies power to the other non-engine related electrically operated components 83 and, when the voltage in the first battery 85 is below the predetermined level, to the electrically operated engine components 79 through a further diode 95.

In the situation where both batteries 85 and 89 are powering the electrically operated engine components 79, the batteries 85 and 89 are kept electrically isolated from each other by the diodes 94 and 95 which preclude electric charge flow from one battery to the other.

From the foregoing description, it should be readily apparent that the described embodiments are very effective in providing adequate power for the electrical components of an engine and its accessories under substantially all conditions without deterioration in performance due to low voltage. Of course, the foregoing description is that of preferred embodiments of the invention and various changes and modifications may be made without departing from the spirit and scope of the invention, as defined by the appended claims.

What is claimed is:

1. An internal combustion engine and control therefore comprised of an internal combustion engine having an output shaft, said engine including at least one electrically operate component required for the operation of the said engine, a battery for supplying electrical power, a generator driven by said engine output shaft, a charging circuit for charging said battery from said generator output, a further electrical accessory powered by said battery and not necessary for engine operation, a voltage sensor for sensing the condition of said battery, and means for increasing the voltage available to said electrically operated component in response to said voltage sensor sensing a battery voltage lower than a predetermined amount by disconnecting the supply of electrical power from said battery to said other electrical accessory.

2. An internal combustion engine and control therefore as set forth in claim 1, wherein the engine output shaft is further coupled to a load for driving load.

3. An internal combustion engine and control therefore as set forth in claim 2, wherein the internal combustion engine is coupled to the load for driving the load through a transmission having at least a neutral condition wherein the engine can run without driving the load and a driving condition wherein the load is driven.

4. An internal combustion engine and control therefore as set forth in claim 3, wherein the means for increasing the voltage available further comprises means for increasing the speed at which the generator is driven.

5. An internal combustion engine and control therefore as set forth in claim 4, wherein the means for increasing the speed at which the generator is driven increases the speed of the engine only when the transmission is in neutral.

6. An internal combustion engine and control therefore as set forth in claim 5, wherein the increased engine speed is reduced when the transmission is shifted into its driving condition from its neutral condition.

7. An internal combustion engine and control therefore comprised of an internal combustion engine having an output shaft, said engine including at least one electrically operate component required for the operation of the said engine, a first battery for supplying electrical power, a generator driven by said engine output shaft, a charging circuit for charging at least said first battery from said generator output, a voltage sensor for sensing the condition of said first battery, and means for increasing the voltage available to said electrically operated component in response to said voltage sensor sensing a battery voltage lower than a predetermined amount, comprising a second battery and means for connecting said second battery to said electrically operated component only when the voltage sensor senses a voltage in said first battery is lower than the predetermined amount.

8. An internal combustion engine and control therefore as set forth in claim 7, wherein another accessory is normally powered by the second battery.

9. An internal combustion engine and control therefore as set forth in claim 8, wherein the other accessory is not required for engine operation.

10. An internal combustion engine and control therefore as set forth in claim 9, wherein the other accessory is normally powered only by the second battery.

11. An internal combustion engine and control therefore as set forth in claim 7, further including an electrically operated starter for starting the engine and powered by the battery.

12. An internal combustion engine and control therefore as set forth in claim 11, wherein the second battery is employed for operating the starter motor.

13. An internal combustion engine and control therefore as set forth in claim 7, wherein the circuit connecting the batteries to the engine and accessories comprises diodes interposed between the batteries and circuits for preventing the connection of one battery to the other battery.

14. A method for operating an internal combustion engine having an output shaft, said engine including at least one electrically operate component required for the operation of the said engine, a further electrical accessory powered by said battery and not necessary for engine operation, a battery for supplying electrical power, a generator driven by said engine output shaft, a charging circuit for charging said battery from said generator output, said method comprising the steps of sensing the condition of said battery and increasing the voltage available to said electrically operated component in response to the sensing of a battery voltage lower than a predetermined amount by discontinuing the supply of electrical power from said battery to said other electrical accessory.

15. A method for operating an internal combustion engine as set forth in claim 14, wherein the engine output shaft is further coupled to a load for driving load.

16. A method for operating an internal combustion engine as set forth in claim 15, wherein the internal combustion engine is coupled to the load for driving the load through a transmission having at least a neutral condition wherein the engine can run without driving the load and a driving condition wherein the load is driven.

17. A method for operating an internal combustion engine as set forth in claim 16, wherein the means for increasing the voltage available further comprises means for increasing the speed at which the generator is driven.

18. A method for operating an internal combustion engine as set forth in claim 17, wherein the speed at which the generator is driven is increased only when the transmission is in neutral.

19. A method for operating an internal combustion engine as set forth in claim 18, wherein the increased speed of the engine is reduced when the transmission is shifted into its driving condition from its neutral condition.

20. A method for operating an internal combustion engine having an output shaft, said engine including at least one electrically operate component required for the operation of the said engine, a first battery for supplying electrical power, a generator driven by said engine output shaft, a charging circuit for charging at least said first battery from said generator output, a second battery said method comprising the steps of sensing the condition of said first battery and increasing the voltage available to said electrically operated component in response to the sensing of a battery voltage lower than a predetermined amount by connecting said second battery to said electrically operated component, and the second battery is only connected to said electrically operated component when the voltage of said first battery is lower than the predetermined amount.

21. A method for operating an internal combustion engine as set forth in claim 20, further including another accessory normally powered by the second battery.

22. A method for operating an internal combustion engine as set forth in claim 20, wherein the other accessory is not required for engine operation.

23. A method for operating an internal combustion engine as set forth in claim 22, wherein the other accessory is normally powered only by the second battery.

24. A method for operating an internal combustion engine as set forth in claim 20, wherein said second battery is employed for operating a starter motor for the engine.

* * * * *